US009152124B2

(12) United States Patent
Mikuni

(10) Patent No.: US 9,152,124 B2
(45) Date of Patent: Oct. 6, 2015

(54) IMAGE FORMING APPARATUS

(71) Applicant: Brother Kogyo Kabushiki Kaisha, Nagoya (JP)

(72) Inventor: Atsushi Mikuni, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/582,333

(22) Filed: Dec. 24, 2014

(65) Prior Publication Data

US 2015/0185687 A1 Jul. 2, 2015

(30) Foreign Application Priority Data

Dec. 27, 2013 (JP) ..... 2013-270930

(51) Int. Cl.
*G03G 15/00* (2006.01)
*G03G 21/16* (2006.01)

(52) U.S. Cl.
CPC ..... *G03G 21/1661* (2013.01); *G03G 21/1652* (2013.01)

(58) Field of Classification Search
CPC ..... G03G 21/1652; G03G 2221/166; G03G 15/80
USPC ..... 399/88–90, 111
See application file for complete search history.

(56) References Cited

U.S. PATENT DOCUMENTS 8,036,570 B2 * 10/2011 Itabashi ..... 399/111
2011/0065336 A1 3/2011 Souda

FOREIGN PATENT DOCUMENTS

JP 2011-64925 A 3/2011

* cited by examiner

*Primary Examiner* — Erika J Villaluna
(74) *Attorney, Agent, or Firm* — Burr & Brown, PLLC

(57) ABSTRACT

An image forming apparatus, including a frame, a cartridge attachable to the frame and including a first on-cartridge electrode and a second on-cartridge electrode, a first electrode protruding from the frame toward the cartridge to contact the first on-cartridge electrode when the cartridge is attached to the frame, and a second electrode protruding from the frame toward the cartridge to contact the second on-cartridge electrode when the cartridge is attached to the frame, is provided. The second electrode is on an upstream side of the first electrode with regard to an attaching direction and in a position to be passed through by the first on-cartridge electrode when the cartridge is moved. When the cartridge is detached from the frame, a tip of the second electrode is closer to the frame than a tip of the first electrode with regard to a facing direction of the cartridge and the frame.

8 Claims, 8 Drawing Sheets

IMAGE FORMING APPARATUS

CROSS REFERENCE TO RELATED APPLICATION

This application claims priority from Japanese Patent Application No. 2013-270930, filed on Dec. 27, 2013, the entire subject matter of which is incorporated herein by reference.

BACKGROUND

1. Technical Field

An aspect of the present invention relates to an image forming apparatus including an electrode, which contacts a mating electrode provided on a cartridge.

2. Related Art

An image forming apparatus having a cartridge, which is detachably attached to a frame, and a plurality of electrodes, which protrude from the frame toward the cartridge, is conventionally known. The electrodes may be arranged in an upstream position and a downstream position along an attaching direction to attach the cartridge to the frame and contact on-cartridge mating electrodes, which are arranged on the cartridge, when the cartridge is correctly attached to the frame. The electrode arranged in the upstream position may be passed over by some of non-mating on-cartridge electrodes when the cartridge is being attached to or detached from the frame.

SUMMARY

In such an image forming apparatus, tips of the plurality of electrodes may align along a facing direction, in which the frame and the cartridge face each other. If the tips of the plurality of electrodes align along the facing direction, however, the electrodes in the upstream position with regard to the attaching direction may collide with the non-mating on-cartridge electrodes. In such a case, sliding resistance for the cartridge being moved may be increased.

The present invention is advantageous in that an image forming apparatus, in which sliding resistance during attaching or detaching movement of the cartridge may be reduced, is provided.

According to an aspect of the present invention, an image forming apparatus, including a frame; a cartridge configured to be detachably attached to the frame along an attaching direction and comprising a first on-cartridge electrode and a second on-cartridge electrode; a first electrode configured to protrude from the frame toward the cartridge and to contact the first on-cartridge electrode when the cartridge is in an attached state with respect to the frame; and a second electrode configured to protrude from the frame toward the cartridge and to contact the second on-cartridge electrode when the cartridge is in the attached state with respect to the frame, is provided. The second electrode is arranged in a position on an upstream side of the first electrode with regard to the attaching direction of the cartridge and in a position to be passed through by the first on-cartridge electrode when the cartridge is moved to be attached to or detached from the frame. When the cartridge is in a detached state with respect to the frame, a tip of the second electrode is in a position closer to the frame than a tip of the first electrode with regard to a facing direction, along which the cartridge and the frame face each other.

BRIEF DESCRIPTION OF THE ACCOMPANYING DRAWINGS

Figure 7A:
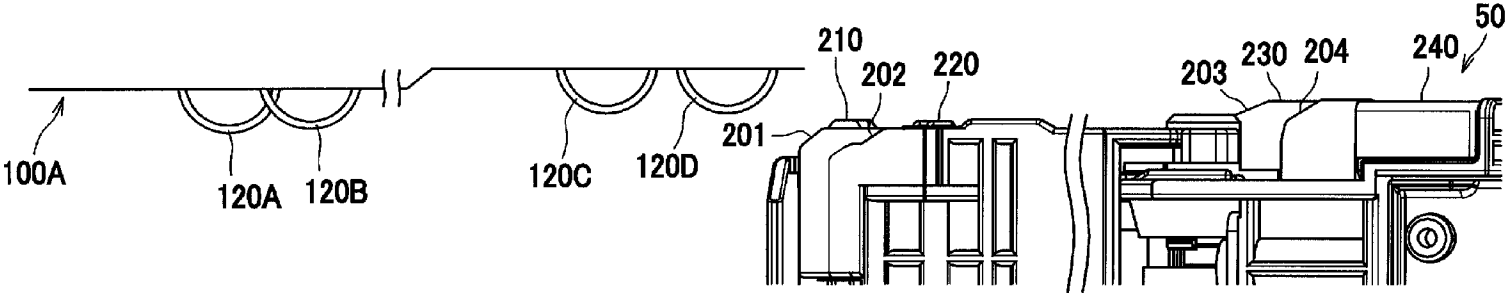
Figure 7B:
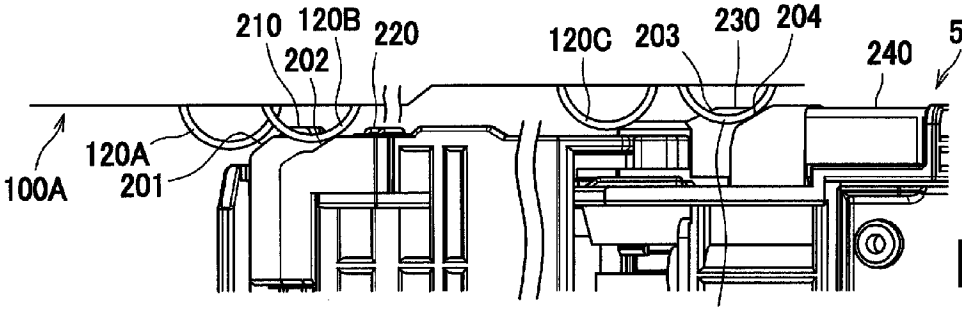
Figure 7C:
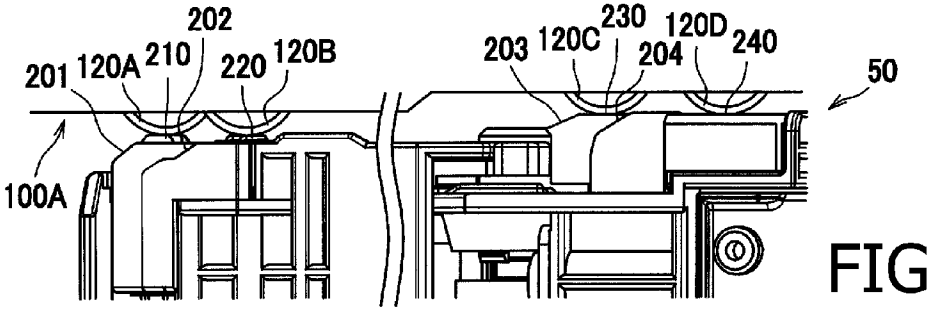

FIG. 7A is an illustrative view of electrodes on the frame before attachment of the processing cartridge to the frame in the laser printer according to the embodiment of the present invention. FIG. 7B is an illustrative view of the electrodes being in contact with guiding parts in cartridge during attachment of the processing cartridge to the frame in the laser printer according to the embodiment of the present invention. FIG. 7C is an illustrative view of the electrodes when the processing cartridge is correctly attached to the frame in the laser printer according to the embodiment of the present invention.

Figure 8:
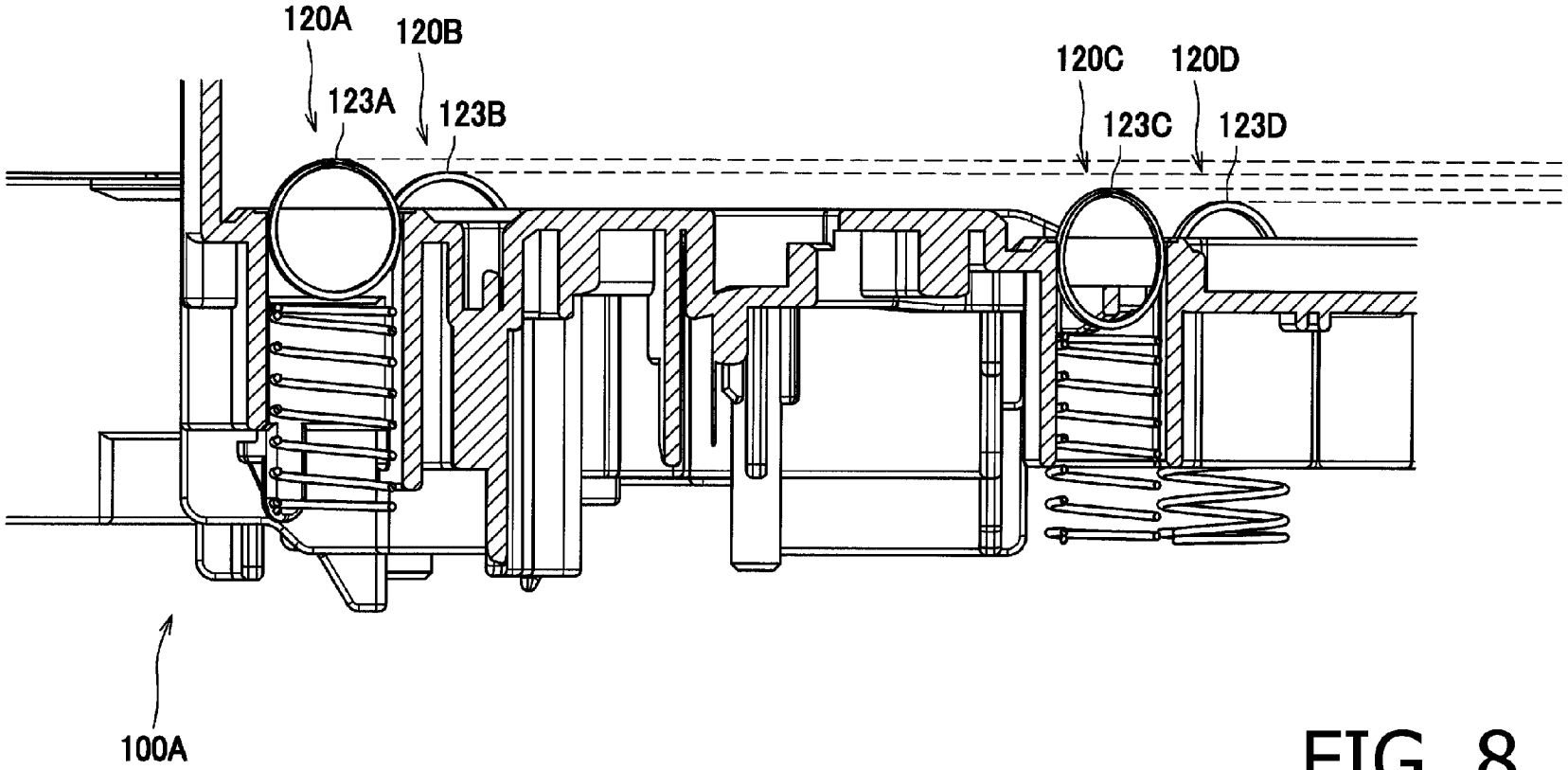

FIG. 8 is a cross-sectional view of the frame on the right in the laser printer according to a modified example of the embodiment of the present invention.

DETAILED DESCRIPTION

Hereinafter, an embodiment according to an aspect of the present invention will be described with reference to the accompanying drawings. In the following description, first, an overall configuration of a laser printer 1 being an image forming apparatus will be described, and second, detailed configuration of specific parts and components in the laser printer 1 will be described.

Figure 1:
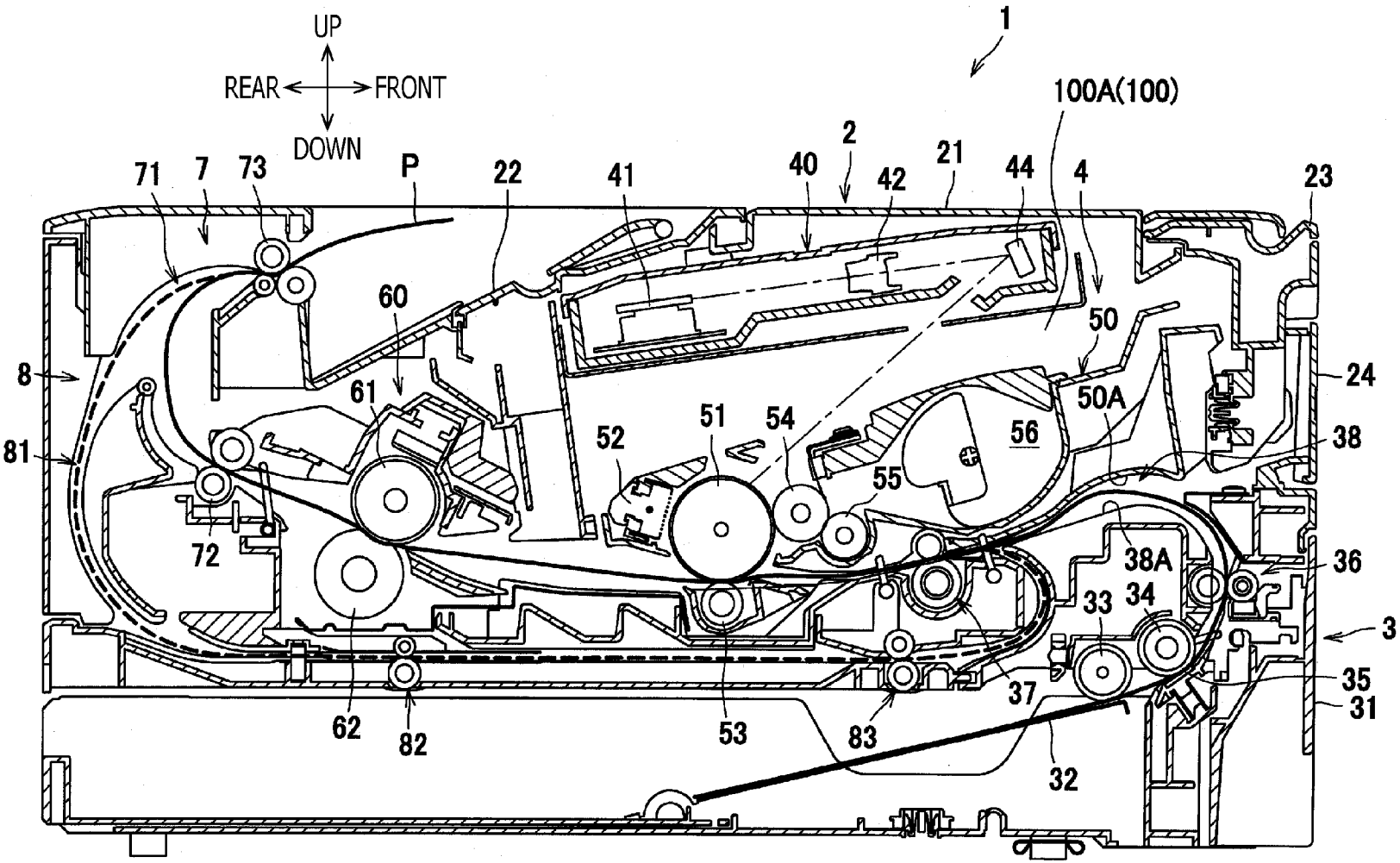
FIG. 1 is a cross-sectional side view of a laser printer according to an embodiment of the present invention.

In the present embodiment, directions concerning the laser printer 1 will be referred to in accordance with orientation indicated by arrows in FIG. 1. For example, a viewer's right-hand side appearing in FIG. 1 is referred to as a front side of the laser printer 1, and a left-hand side in FIG. 1 opposite from the front side is referred to as a rear side. A side which corresponds to the viewer's nearer side is referred to as left, and an opposite side from the left, which corresponds to the viewer's farther side is referred to as right. The up-down direction in FIG. 1 corresponds to a vertical direction of the laser printer 1. Further, directions of the drawings in FIGS. 2-8 are similarly based on the orientation of the laser printer 1 as defined above and correspond to those with respect to the laser printer 1 shown in FIG. 1 even when the laser printer 1 and the components are viewed from different angles. A front-to-rear or rear-to-front direction is defined as a direction of depth and may be referred to as a front-rear direction. A right-to-left or left-to-right direction of the laser printer 1 may also be referred to as a right-left direction or a widthwise direction.

Overall Configuration of the Laser Printer

As shown in FIG. 1, the laser printer 1 is configured to form images on either side of a sheet P and includes a body 2, which accommodates a feeder unit 3, an image forming unit 4, an ejection unit 7, and a reversing unit 8.

The body 2 includes a front cover 23 on a front side thereof. The front cover 23 is opened when a processing cartridge 50 is to be attached to or removed from the body 2. The front cover 23 is equipped with a manual sheet tray 24, which is rotatable and on which sheets P to be manually fed to the laser printer 1 are placed. The body 2 includes a pair of frames 100, which support the processing cartridges 50 laterally. Hereinafter, one of the paired frames 100 which is on the right will be referred to as a frame 100A.

The feeder unit 3 is configured to feed the sheets P to the image forming unit 4 and is disposed in a lower position in the body 2. The feeder unit 3 includes the feeder tray 31, a sheet-pressing plate 32, a pickup roller 33, a separator roller 34, a separator pad 35, a pair of conveyer rollers 36, a pair of registration rollers 37, and a feeder path 38.

The feeder path 38 is formed to convey the sheet P fed from the feeder tray 31 to the image forming unit 4, for example, to a position between a photosensitive drum 51 and a transfer roller 53. The feeder path 38 extends upper-frontward from an area in the vicinity of the pickup roller 33 and curves rearward toward the position between the photosensitive drum 51 and the transfer roller 53. The feeder path 38 is mostly formed by a bottom plane 50A of the processing cartridge 50 and a conveyer guide 38A arranged to face the bottom plane 50A.

The sheets P placed on the feeder tray 31 are pressed to be closer to the pickup roller 33 by the sheet-pressing plate 32 and forwarded to the feeder path 38 by the pickup roller 33. The sheets P are separated from one another by the separator roller 34 and the separator pad 35 and conveyed one-by-one by the paired conveyer rollers 36. Skewed orientation of the sheets P is corrected by the paired registration rollers 37, and the sheets P are thereafter conveyed toward the image forming unit 4.

The image forming unit 4 is configured to form an image on the conveyed sheet P and is disposed in an upper position with respect to the feeder tray 31. The image forming unit 4 includes an exposure device 40, the processing cartridge 50, and a fixing device 60.

The exposure device 40 is disposed in an upper position in the body 2 and includes a laser emitter (not shown), a rotatably-driven polygon mirror 41, a lens 42, and a reflection mirror 44. The laser emitter emits a laser beam according to image data, and the emitted laser beam is reflected on the polygon mirror 41, transmits through the lens 42, and is reflected on the reflection mirror 44, as indicated by a dash-and-dot line in FIG. 1, to scan a surface of the photosensitive drum 51.

The processing cartridge 50 is disposed in a lower position with respect to the exposure device 40 and includes the photosensitive drum 51, a charger 52, the transfer roller 53, a developer roller 54, a supplier roller 55, and a toner container 56 to contain toner.

The processing cartridge 50 is detachably attached to the frames 100. More specifically, the processing cartridge 50 is inserted rearward in the body 2 through an opening (unsigned), which is exposed on the front side of the body 2 when the front cover 23 is opened, to be attached to the frames 100. In the following description, a direction to attach the processing cartridge 50 to the frames 100, i.e., rearward from the front, will be referred to as an attaching direction.

Figure 2:
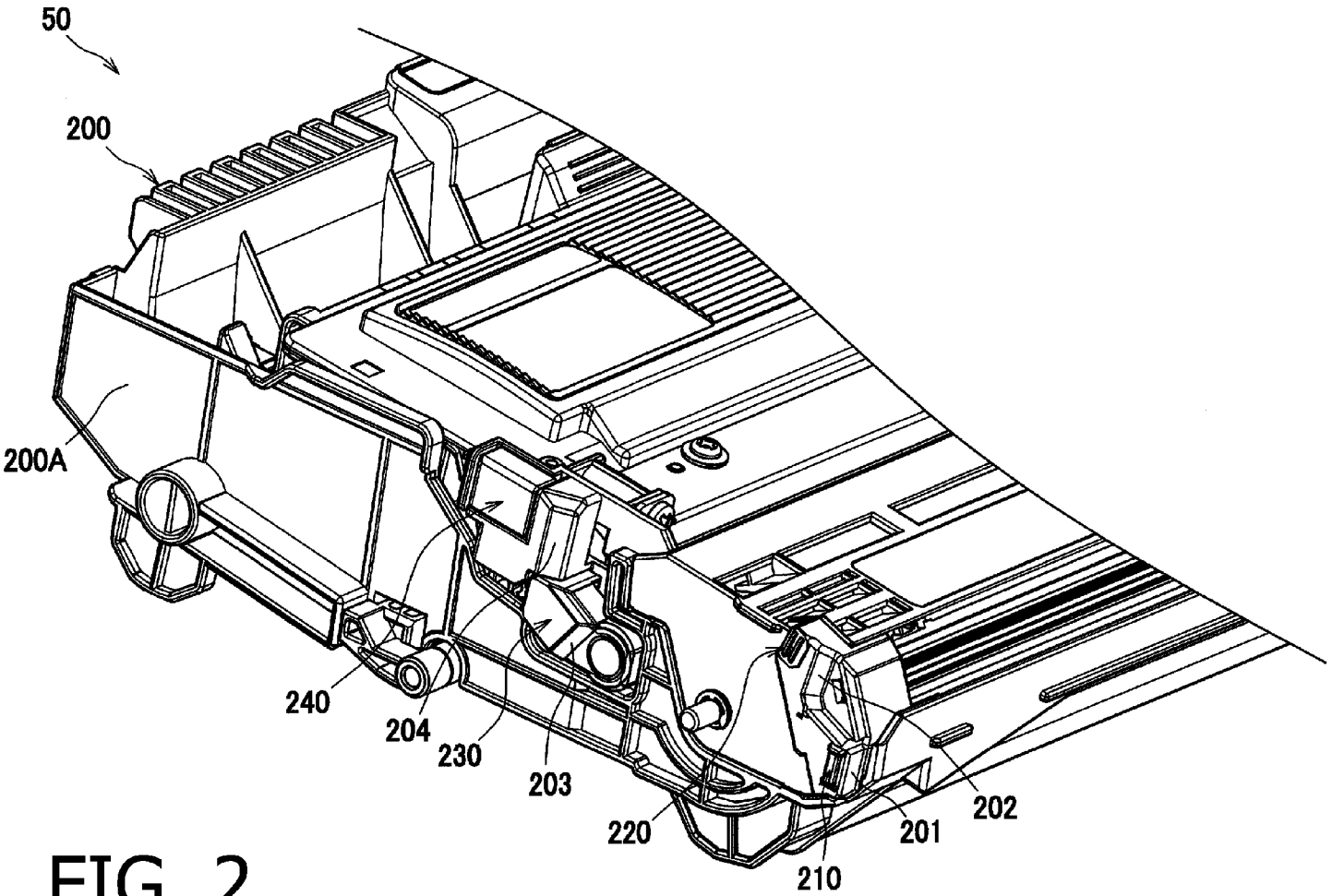
FIG. 2 is a perspective view of a rightward part of a processing cartridge in the laser printer according to the embodiment of the present invention.
Figure 3:
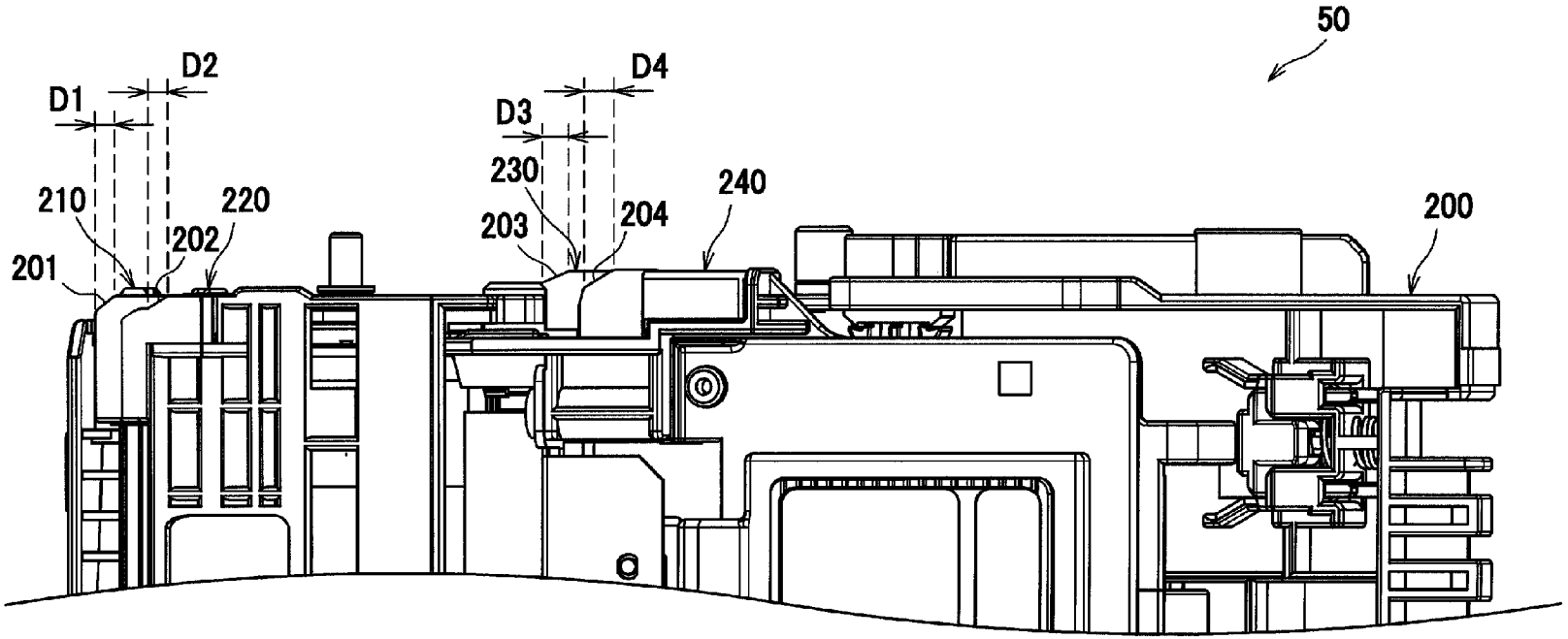
FIG. 3 is an upper plan view of the rightward part of the processing cartridge in the laser printer according to the embodiment of the present invention.

As shown in FIGS. 2 and 3, the processing cartridge 50 is equipped with a plurality of on-cartridge electrodes, which include a grid-electrode 210, a charger-electrode 220, a developer-electrode 230, and a supplier-electrode 240, on a rightward lateral face 200A of a chassis 200 thereof.

The grid-electrode 210 is an electrode to apply bias to a grid of the charger 52. The charger-electrode 220 is an electrode to electrically charge a wire in the charger 52 and is disposed on an upstream side of the grid-electrode 210 with regard to the attaching direction, in an upper position with respect to the grid-electrode 210. The grid-electrode 210 and the charger-electrode 220 are in arrangement such that terminals thereof are located in a same widthwise position with regard to the widthwise direction.

The developer-electrode 230 is an electrode to apply developer bias to the developer roller 54. The supplier-electrode 240 is an electrode to apply supplier bias to the supplier roller 55 and is disposed on an upstream side of the developer-electrode 230 with regard to the attaching direction, in an upper position with respect to the developer-electrode 230. The developer-electrode 230 and the supplier-electrode 240 are arranged on an upstream side of the grid-electrode 210 and the charger-electrode 220 with regard to the attaching direction, and in rightward protruded positions, i.e., on a side closer to the frame 100A on the right, than the grid-electrode 210 and the charger-electrode 220 along the widthwise direction. The developer-electrode 230 and the supplier-electrode 240 are in arrangement such that terminals thereof are located in a same widthwise position with regard to the widthwise direction.

On a downstream side of the grid-electrode 210 along the attaching direction, arranged is a grid-guide 201. On a downstream side of the charger-electrode 220 along the attaching direction, arranged is a charger-guide 202. On a downstream side of the developer-electrode 230 along the attaching direction, arranged is a developer-guide 203. And on a downstream side of the supplier-electrode 240 along the attaching direction, arranged is a supplier-guide 204.

The grid-guide 201, the charger-guide 202, the developer-guide 203, and the supplier-guide 204 are guiding surfaces, which serve to compress first electrodes 120A, 120B and second electrodes 120C, 120D and guide toward the mating electrodes respectively, when the processing cartridge 50 is attached to the frames 100. The first electrodes 120A, 120B and the second electrodes 120C, 120D will be described later in detail. The grid-guide 201, the charger-guide 202, the developer-guide 203, and the supplier-guide 204 are formed to incline with respect to the attaching direction to approach closer to the frame 100A on the right as they extend from downstream ends toward upstream ends along the attaching direction.

As shown in FIG. 3, a dimension D3 of the developer-guide 203 along the attaching direction and a dimension D4 of the supplier-guide 204 along the attaching direction are greater than a dimension D1 of the grid-guide 201 along the attaching direction and a dimension D2 of the charger-guide 202 along the attaching direction.

As shown in FIG. 1, the fixing device 60 is disposed in a rearward position with respect to the processing cartridge 50 and includes a heat roller 61 and a pressure roller 62. The pressure roller 62 is arranged to face the heat roller 61 and is pressed against the heat roller 61.

In the image forming unit 4, the surface of the photosensitive drum 51 is electrically charged evenly by the charger 52 as the photosensitive drum 51 rotates and is selectively exposed to the laser beam emitted from the exposure device 40. Thereby, potential in the exposed areas on the surface is lowered, and a latent image is formed on the surface of the photosensitive drum 51. Meanwhile, the toner in the toner container 56 is supplied to the developer roller 54 through the supplier roller 55 and carried on a surface of the developer roller 54.

The toner on the surface of the developer roller 54 is thereafter supplied to the latent image on the photosensitive drum 51, and the image is developed to be a toner image. While the sheet P is conveyed to the position between the photosensitive drum 51 and the transfer roller 53, the toner image carried on the surface of the photosensitive drum 51 is transferred to the sheet P. Thereafter, when the sheet P is conveyed through the position between the heat roller 61 and the pressure roller 62, the toner image on the sheet P is thermally fixed thereat.

The ejection unit 7 is configured to convey the sheet P with the thermally fixed toner image outward from the body 2 and includes an ejection path 71, a conveyer roller 72, and an ejection roller 73.

The ejection path 71 is a path to guide the sheet P conveyed from the fixing device 60 along a curvature toward an ejection tray 22.

The ejection roller 73 is disposed in the vicinity of an outlet of the ejection path 71 and is rotatable in normal and reverse directions according to a known control method. For example, when the ejection roller 73 rotates in the normal direction, the sheet P is conveyed outward to be ejected out of the body 2, and when the rejection roller 73 rotates in the reverse direction, the sheet P is conveyed toward the reversing unit 8.

In the ejection unit 7, the sheet P, which is indicated by a solid line in FIG. 1 and ejected out of the image forming unit 4, is conveyed upper-rearward and thereafter frontward toward the ejection roller 73 along a curve. When the image is to be formed solely on one side of the sheet P, or when the images are completed on both sides of the sheet P, the sheet P is ejected outside the body 2 and placed on the ejection tray 22, which is arranged on a top part of the body 2.

Meanwhile, after completion of the image on one side of the sheet P, and if another image is to be formed on the other side of the sheet P, the sheet P is conveyed outward from the body 2 by the ejection roller 73 rotating in the normal direction. The ejection roller 73, however, starts rotating in the reverse direction before the sheet P is completely ejected out of the body 2 so that the sheet P is drawn back inside the body 2 and conveyed to the reversing unit 8, as indicated by a broken line in FIG. 1.

The reversing unit 8 is configured to convey the sheet P, which has been reversed upside-down, again toward the image forming unit 4 so that the images are to be formed on the other side of the sheet P. The reversing unit 8 includes a return-conveyer path 81 and a pair of return-conveyer rollers 82, 83.

The return-conveyer path 81 is a path to guide the sheet P with the image formed on the recto thereof to the feeder path 38 according to the reverse rotation of the ejection roller 73. More specifically, the return-conveyer path 81 is branched off from a rear-end part of the ejection path 71 to extend downward and curves frontward to extend frontward over the feeder tray 31. Further, the return-conveyer path 81 extends through the rearward return-conveyer rollers 82 to the frontward return-conveyer rollers 83. Moreover, the return-conveyer path 81 curves upward and merges with the feeder path 38.

In the reversing unit 8, the sheet P conveyed by the reverse rotation of the ejection roller 73 is, as indicated by the broken line in FIG. 1, conveyed in the return-conveyer path 81 to the feeder path 38 again to be conveyed to the image forming unit 4. Thereafter, another image is formed on the verso of the sheet P as the sheet P is conveyed in the image forming unit 4, as indicated by the solid line in FIG. 1, and the sheet P is ejected outside the body 2 by the ejection unit 7 and placed on the ejection tray 22.

Detailed Frame Structure

Figure 4:
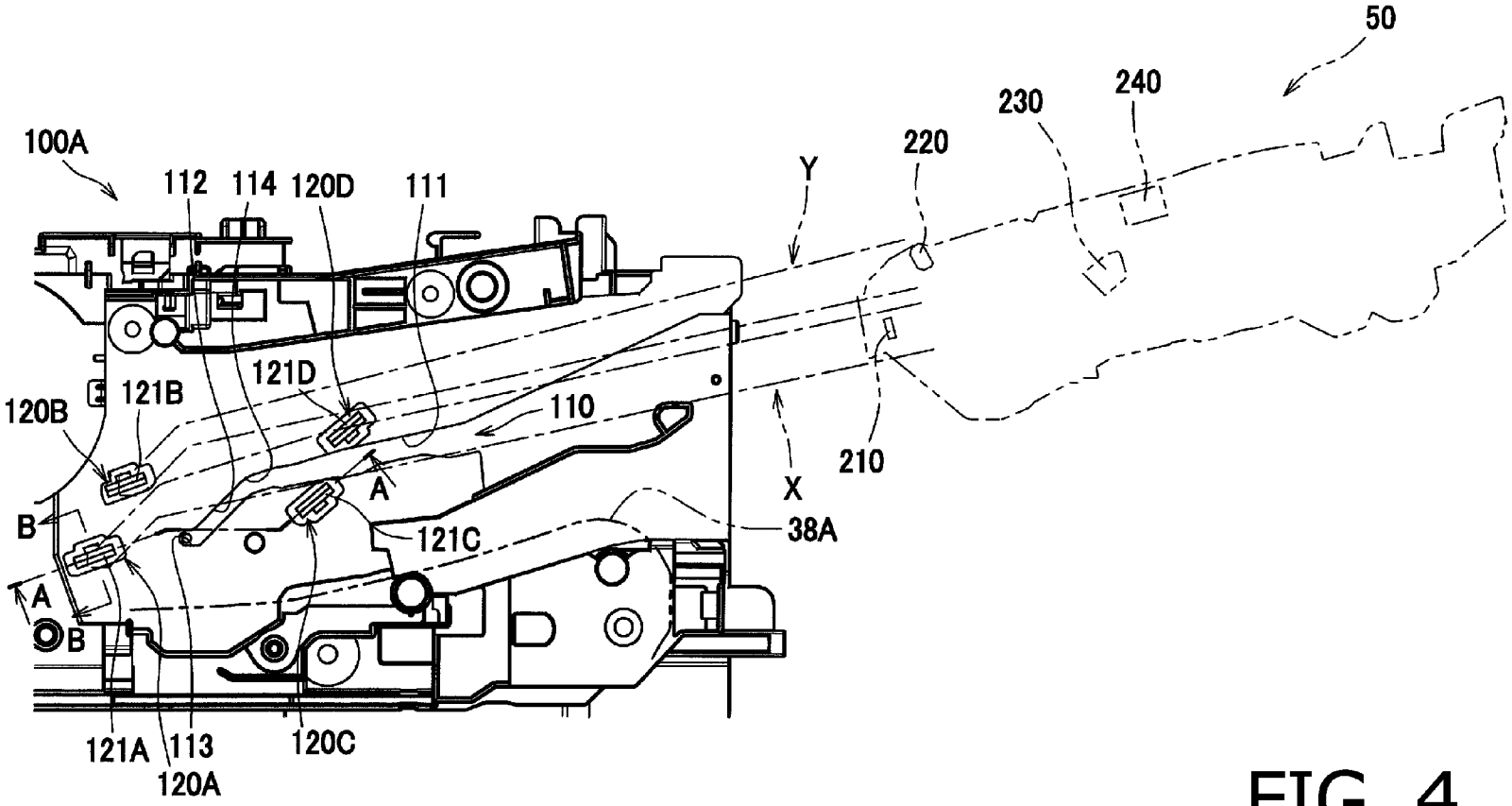
FIG. 4 is an inner-side view of a frame on the right in the laser printer according to the embodiment of the present invention.

As shown in FIG. 4, each of the paired frames 100 includes a guide 110, which guides the processing cartridge 50 to move there-along. The guide 110 is a groove formed on an inner side of each frame 100, and a shaft (not shown) on the photosensitive drum 51 is guided therein. The guide 110 includes a first guiding part 111, a second guiding part 112, and a third guiding part 113.

The first guiding part 111 is on an upstream side in the guide 110 with regard to the attaching direction and extends along a first direction, which inclines with respect to a horizontal direction (e.g., the front-rear direction) to be lower at a downstream side and higher at the upstream side along the attaching direction.

The second guiding part 112 is on a downstream side of the first guide 111 with regard to the attaching direction and extends along a second direction, which is different from the first direction. The second direction inclines with respect to the horizontal direction to be lower at the downstream side and higher at the upstream side along the attaching direction at a larger angle than an angle between the horizontal direction and the first direction.

Thus, the second guiding part 112 extends from a transitive part 114, which is at an upstream of the second direction and connects the first guiding part 111 and the second guiding part 112 with each other, in inclination toward a downstream of the second direction to approach closer to the conveyer guide 38A, which is in the lower position with respect to the processing cartridge 50.

The third guiding part 113 is at a downstream end in the guide 110 with regard to the attaching direction and extends from a lower end (the downstream end) of the second guiding part 112 along a third direction (e.g., the front-rear direction), which is different from the second direction.

The guide 110 with the first guiding part 111, the second guiding part 112, the third guiding part 113 guides the processing cartridge 50 to place the processing cartridge 50 in an attached state at a predetermined attached position (see FIG. 1). When the processing cartridge 50 is guided through the first guide part, the second guiding part 112, and the third guiding part 113, the grid-electrode 210 moves within a course X, and the charger-electrode 220 moves within a course Y.

On the frame 100A on the right, arranged are first electrodes 120A, 120B and second electrodes 120C, 120D, which supply electricity to the electrodes 210, 220, 230, 240 on the processing cartridge 50 respectively.

The first electrode 120A being on a downstream side with respect to the first electrode 120B along the attaching direction is located in a position corresponding to the grid-electrode 210, when the processing cartridge 50 is attached to the frame 100A. Meanwhile, the first electrode 120B on an upstream side along the attaching direction is located in a position corresponding to the charger-electrode 220, when the processing cartridge 50 is attached to the frame 100A.

The second electrode 120C being on a downstream side with respect to the second electrode 120D along the attaching direction is located in a position corresponding to the developer-electrode 230, when the processing cartridge 50 is attached to the frame 100A. Meanwhile, the second electrode 120D on an upstream side along the attaching direction is located in a position corresponding to the supplier-electrode 240, when the processing cartridge 50 is attached to the frame 100A.

Figure 5:
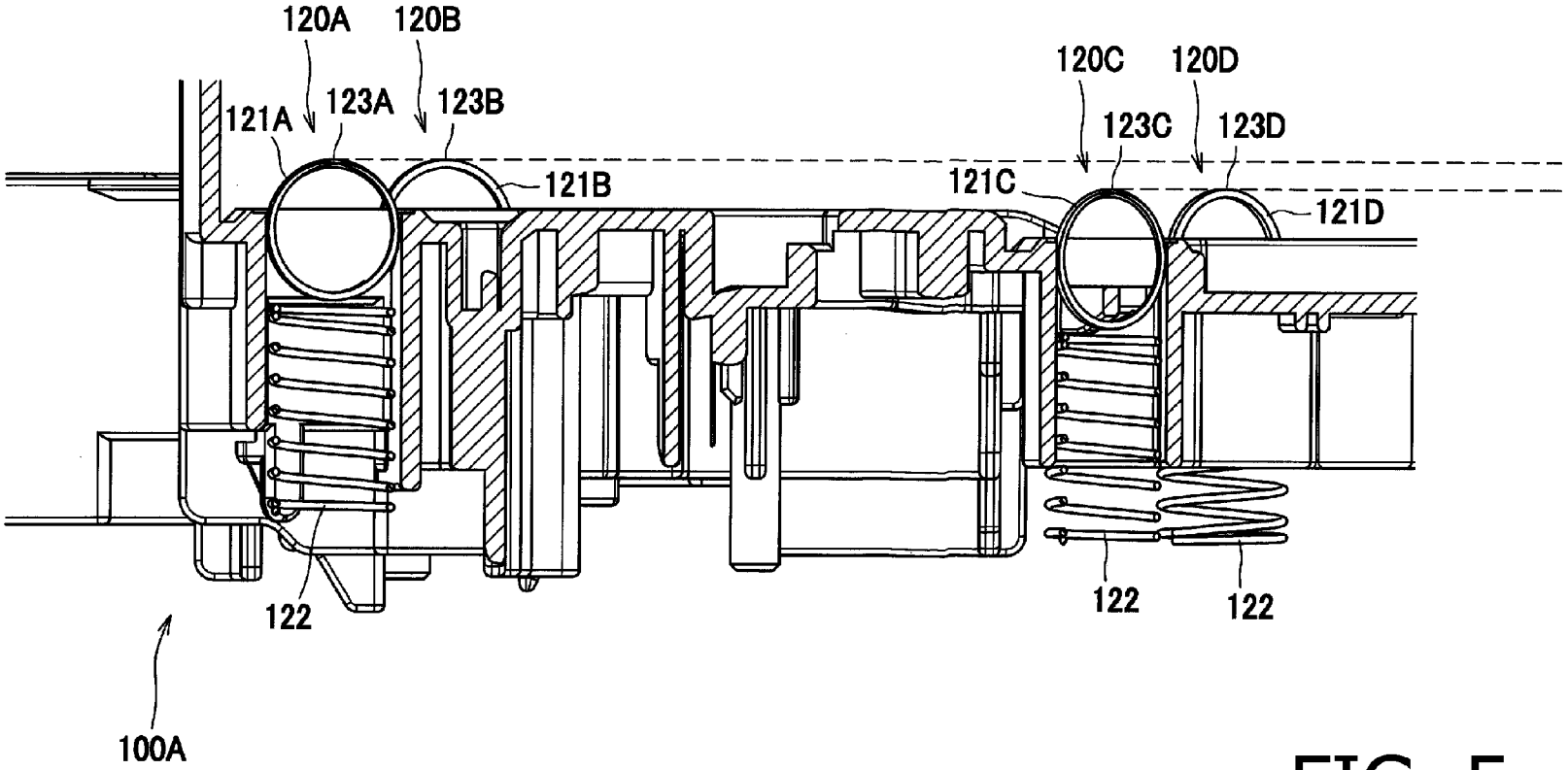
FIG. 5 is a cross-sectional view of the frame on the right in the laser printer according to the embodiment of the present invention taken along a line A-A shown in FIG. 4.

Each of the first electrodes 120A, 120B and the second electrodes 120C, 120D is a wire electrode including, as shown in FIG. 5, a ring portion 121, which is rounded at least twice in two loops, and a coiled spring 122, which is connected to the ring portion 121.

In the following description and the drawings mentioned in the following description, reference signs of parts or components corresponding to the first electrode 120A on the downstream side and the first electrode 120B on the upstream side may be accompanied by a capital "A" and a capital "B" respectively. Meanwhile, reference signs of parts or components corresponding to the second electrode 120C on the downstream side and the second electrode 120D on the upstream side may be accompanied by a capital "C" and a capital "D" respectively.

The ring portions 121A, 121B, 121C, 121D are arranged to protrude inwardly with regard to the widthwise direction from the frame 100A. Therefore, the first electrodes 120A, 120B and the second electrodes 120C, 120D are placed to be in contact with the electrodes 210, 220, 230, 240 in the respective corresponding positions in the processing cartridge 50.

As shown in FIG. 4, the ring portions 121A, 121B of the first electrodes 120A, 120B are located on a downstream side of the guide 110, or the transitive part 114 between the first guiding part 111 and the second guiding part 112, with regard to the attaching direction. The ring portions 121A, 121B are in an arrangement such that, when viewed along the widthwise direction, a diameter thereof inclines with respect to the horizontal direction (i.e., the front-rear direction) at an angle, which is between the angle of the second guiding part 112 with respect to the horizontal direction and the angle of the third guiding part 113 with respect to the horizontal direction.

The ring portions 121C, 121D of the second electrodes 120C, 120D are located on an upstream side of the transitive part 114 with regard to the attaching direction and in an arrangement such that, when viewed along the widthwise direction, a diameter thereof inclines with respect to the horizontal direction to be in parallel with the second direction, which is the extending direction of the second guiding part 112.

The second electrode 120D on the upstream side along the attaching direction is located in a position to overlap the course X for the grid-electrode 210. In other words, the second electrode 120D on the upstream side is located in a position, through which the grid-electrode 210 passes when the processing cartridge 50 is being attached to or detached from the frames 100.

As shown in FIG. 5, tips 123A, 123B of the first electrodes 120A, 120B are arranged to align in same positions with regard to the widthwise direction. Tips 123C, 123D of the second electrodes 120C, 120D are arranged to align in same positions with regard to the widthwise direction.

When the processing cartridge 50 is in a detached state, where the processing cartridge 50 is detached from the frame 100A, the tips 123C, 123D of the second electrodes 120C, 120D are in positions closer to the frame 100A than the tips 123A, 123B of the first electrodes 120A, 120B, i.e., outward positions, with regard to a facing direction, along which the processing cartridge 50 and the frame 100A face each other, i.e., the widthwise direction.

The coiled springs 122 are compressed springs, which urge the ring portions 121A, 121B, 121C, 121D toward the processing cartridge 50. The coiled springs 122 are compressed outwardly along the widthwise direction when the first electrodes 120A, 120B and the second electrodes 120C, 120D contact the mating electrodes 210, 220, 230, 240 respectively.

Figure 6:
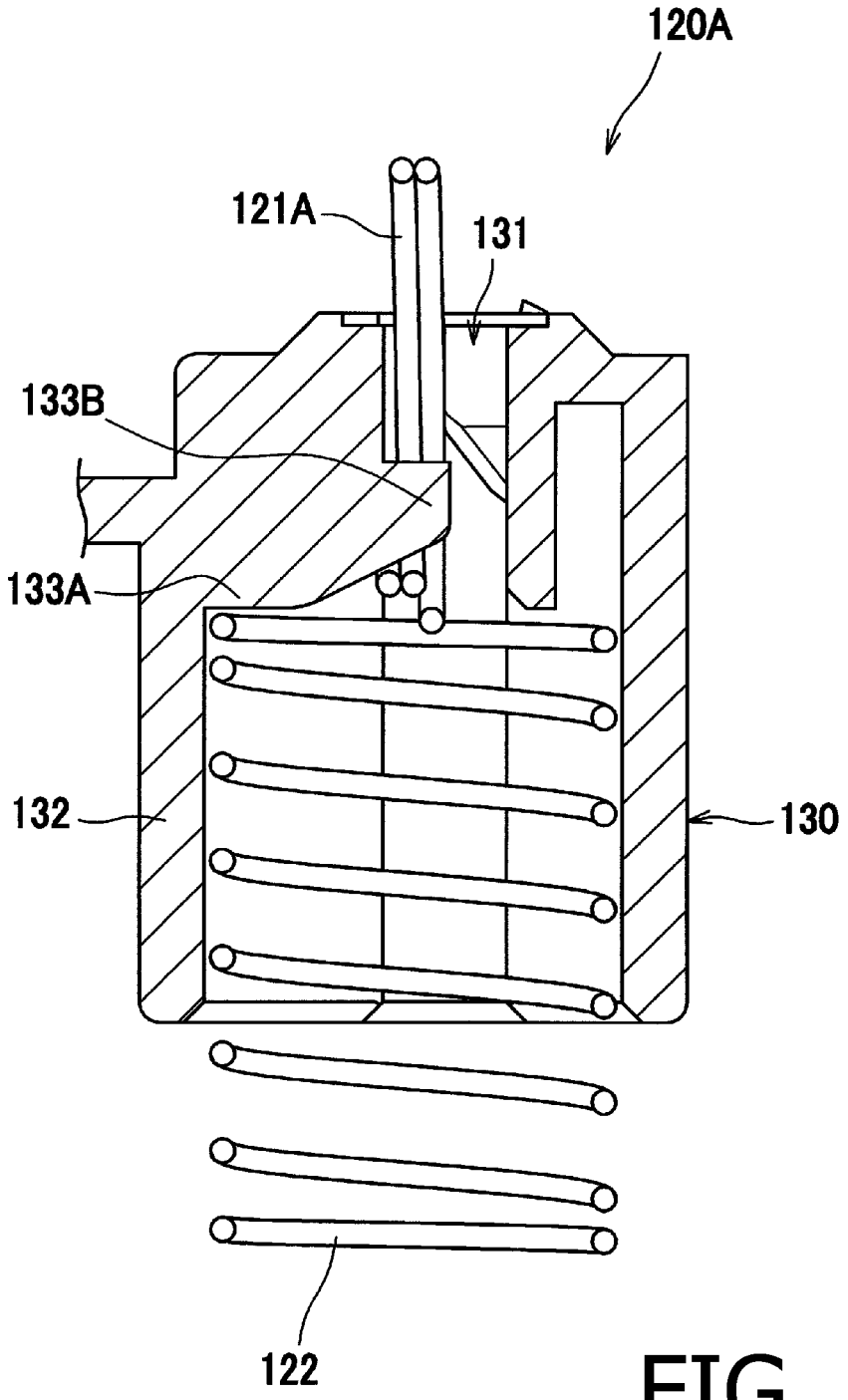
FIG. 6 is a cross-sectional view of the frame on the right in the laser printer according to the embodiment of the present invention taken along a line B-B shown in FIG. 4.

Each of the first electrodes 120A, 120B, the second electrodes 120C, 120D is, as shown in FIG. 6, accommodated in a holder part 130, which is arranged in the frame 100A (in FIG. 6, solely the first electrode 120A on the downstream side is shown). In the following description, solely the holder part 130 for the first electrode 120A on the downstream side, which represents the holder parts 130 for the first electrodes 120A, 120B, and the second electrodes 120C, 120D, will be explained, and explanation of the holder parts 130 for the first electrode 120B and the second electrodes 120C, 120D will be omitted.

The holder part 130 is formed to have a cylindrical shape and guides the coiled spring 122 by an inner peripheral surface thereof. The holder part 130 is formed to have an opening 131, which is open upwardly in FIG. 6 (i.e., inwardly along the widthwise direction), so that the ring portion 121A of the first electrode 120A is arranged to penetrate the holder part 130 through the opening 131. Thus, the ring portion 121A is allowed to protrude at the side of the processing cartridge 50 from the frame 100A.

The holder part 130 includes a first restrictive portion 133A and a second restrictive portion 133B. The first restrictive portion 133A protrudes rightward from a wall 132 on the left in FIG. 6. The second restrictive portion 133B protrudes further rightward from the first restrictive portion 133A in FIG. 6. The first restrictive portion 133A is arranged in a position to be in contact with an upper end of the coiled spring 122, in FIG. 6. Therefore, the coiled spring 122 is restricted from moving upward, in FIG. 6, and the first electrode 120A on the downstream side is restricted from protruding excessively from the frame 100A.

The second restrictive portion 133B is arranged to be inserted in the ring portion 121A of the first electrode 120A so that the second restrictive portion 133B is hooked with a lower end of the ring portion 121A when the first restrictive portion 133A restricts the coiled spring 122 from moving upward, in FIG. 6. With the second restrictive portion 133B, by modifying a vertical position, in FIG. 6, of the second restrictive portion 133B, a protrusive amount of the ring portion 121A to protrude from the frame 100A may be adjusted.

With the laser printer 1 configured as above, when the processing cartridge 50 is not attached to the frame 100A, as shown in FIG. 7A, the first electrodes 120A, 120B and the second electrodes 120C, 120D are in a maximally protruded condition protruding from the frame 100A. When the processing cartridge 50 is moved to be attached to the frame 100A, the processing cartridge 50 is guided along the guides 110 of the frames 100 toward the attached position. In particular, the processing cartridge 50 moves in the first direction along the first guiding part 110, thereafter in the second direction along the second guiding part 112, and in the third direction along the third guide 113.

Meanwhile, the grid-electrode 210 on the downstream side with regard to the attaching direction passes through the position of the second electrode 120D on the upstream side. In this regard, the second electrode 120D protruding from the frame 100A may contact the grid-electrode 210, and if the sliding resistance between the second electrode 120D and the grid-electrode 210 is substantially large, the ring portion 121D of the first electrode 120D may be distorted by the collision. When the ring portion 121D of the second electrode 120D is distorted, an area in the second electrode 120D to contact the mating supplier-electrode 240 may be reduced, and connection between the second electrode 120D and the mating supplier-electrode 240 may be loosened.

According to the present embodiment, however, the tip 123D of the second electrode 120D is arranged in the position closer to the inner surface of the frame 100A than the first electrodes 120A, 120B with regard to the widthwise direction. Therefore, the second electrode 120D may not contact the grid-electrode 210 easily, and, when the grid-electrode 210 passes by the second electrode 120D, the sliding resistance between the grid-electrode 210 and the second electrode 120D may be reduced. Accordingly, the second electrode 120D may be restrained from being distorted by the close contact with the grid-electrode 210, and the loose connection between the second electrode 120D and the supplier electrode 240 may be restrained.

While the second electrodes 120C, 120D are in the positions closer to the inner surface of the frame 100A than the first electrodes 120A, 120B, the second electrodes 120C, 120D may not easily contact the mating developer-electrode 230 or the mating supplier-electrode 240, either. However, according to the present embodiment, the developer-electrode 230 and the supplier-electrode 240 protrude toward the frame 100A with respect to the grid-electrode 210 and the charger-electrode 220. Therefore, the second electrodes 120C, 120D may easily contact the mating developer-electrode 230 and the mating supplier-electrode 240 respectively.

Meanwhile, when the processing cartridge 50 is moving in the second guiding part 112, the second electrodes 120C, 120D climb over the developer-guide 203 and the supplier-guide 204 and are compressed by the developer-guide 203 and the supplier-guide 204 respectively. In this regard, the processing cartridge 50 moves in the second direction; therefore, if the second electrodes 120C, 120D were arranged to align along the horizontal direction, the second electrodes 120C, 120D may have difficulty in climbing on the developer-guide 203 and the supplier-guide 204. Accordingly, the second electrodes 120C, 120D may be distorted.

However, according to the present embodiment, the second electrodes 120C, 120D are arranged along the inclination with respect to the horizontal direction, in parallel with the second guiding part 112. Therefore, the second electrodes 120C, 120D may easily and smoothly climb on the developer-guide 203 and the supplier-guide 204 until the second electrodes 120C, 120D reach and contact the mating developer-electrode 230 and the mating supplier-electrode 240 respectively. Thus, the sliding resistance between the second electrodes 120C, 120D and the developer-electrode 230, the supplier-electrode 240 when they contact one another may be reduced.

Meanwhile, when the processing cartridge 50 is moved through the downstream side of the second guiding part 112 along the second direction toward the third guide 113, the first electrodes 120A, 120B climb on the mating grid-guide 201 and the mating charger-guide 202 respectively to be compressed. In this regard, the moving direction of the processing cartridge 50 is shifted from the second direction to the third direction. Therefore, the first electrodes 120A, 120B may have difficulty in climbing on the grid-guide 201 and the charger-guide 202, and the first electrodes 120A, 120B may be distorted.

However, according to the present embodiment, the first electrodes 120A, 120B are arranged to incline at the angle between the second guiding part 112 and the third guiding part 113. Therefore, within the series of movements of the processing cartridge 50, the first electrodes 120A, 120B may climb on the grid-guide 201 and the charger-guide 202 easily. Thus, the sliding resistance between the first electrodes 120A, 120B and the grid-electrode 210, the charger-electrode 220 when they contact one another may be reduced.

If the grid-guide 201 on the processing cartridge 50 is smaller than the supplier-guide 204, when the grid-electrode 210 passes by the second electrode 120D on the frame 100A on the upstream side along the attaching direction, the second electrode 120D contacting the grid-guide 201 may not steadily climb on the grid-guide 201, but may contact the grid-electrode 210 easily or directly. Therefore, for example, if the second electrode 120D was configured to contact the grid-electrode 210 easily or directly, the second electrode 120D might not smoothly be compressed by the grid-guide 201 or the grid electrode 210 and might be distorted.

However, according to the present embodiment, the second electrode 120D is in the position closer to the inner surface of the frame 100A than the grid-electrode 210. Therefore, the second electrode 120D may not necessarily contact the grid-electrode 210 easily or directly but may be restrained from being distorted.

Meanwhile, as shown in FIG. 7C, the first electrodes 120A, 120B and the second electrodes 120C, 120D are guided to contact the mating electrodes 210, 220, 230, 240 along the guides 201, 202, 203, 204 respectively, where the processing cartridge 50 is attached to the frames 100.

According to the present embodiment, the frame 100A is equipped with the first restrictive portion 133A and the second restrictive portion 133B; therefore, the first electrodes 120A, 120B and the second electrodes 120C, 120D may be restricted from protruding excessively from the frame 100A.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the tips 123A, 123B of the first electrodes 120A, 120B may not necessarily be arranged in the same positions with regard to the widthwise direction, or the tips 123C, 123D of the second electrodes 120C, 120*d* may not necessarily be arranged in the same positions with regard to the widthwise direction. For example, as shown in FIG. 8, the tips 123A, 123B, 123C, 123D of the first and second electrodes 120A, 120B, 120C, 120D may be arranged in different positions from one another.

In the example shown in FIG. 8, the tip 123B of the first electrode 120B on the upstream side may be arranged in a position closer to the surface of the frame 100A than the tip 123A of the first electrode 120A on the downstream side with regard to the widthwise direction. Meanwhile, the tip 123D of the second electrode 120D on the upstream side may be arranged in a position closer to the surface of the frame 100A than the tip 123C of the second electrode 120C on the downstream side with regard to the widthwise direction. Thus, the first and second electrodes 120A, 120B, 120C, 120D may be arranged such that: the tips 123A, 123B, 123C, 123D which are closer to the upstream of the attaching direction are closer to the frame 100A. In other words, the closer to the upstream of the attaching direction the tips 123A, 123B, 123C, 123D approach, the closer to the frame 100A the tips 123A, 123B, 123C, 123D are.

In this regard, the electrodes which are in the positions closer to the upstream may tend to contact the rightward lateral face 200A of the processing cartridge 50 being moved more easily. However, according to the configuration described above, in which the tips 123A, 123B, 123C, 123D of the first and second electrodes 120A, 120B, 120C, 120D in the positions closer to the upstream are closer to the frame 100A, the sliding resistance between the electrodes and the rightward lateral face 200A may be reduced, and the tips

123A, 123B, 123C, 123D of the first and second electrodes 120A, 120B, 120C, 120D may be restrained from being contacted by the rightward lateral face 200A to be distorted.

For another example, the second electrode 120D on the upstream side may not necessarily be located in the course X of the grid-electrode 210 but may be located within the course Y of the charger-electrode 220. For another example, the second electrode 120C on the downstream side may be located within the course X of the grid-electrode 210 or the course Y of the charger-electrode 220.

For another example, each ring portion 121A of the first and second electrodes 120A, 120B, 120C, 120D may not necessarily be rounded twice in two loops but may be rounded in, for example, three or more times in three or more loops.

For another example, the guides 110 may not necessarily guide the processing cartridge 50 in three directions continuously but may guide in, for example, one (straight) direction.

For another example, the ring portions 121A, 121B, 121C, 121D of the first and second electrodes 120A, 120B, 120C, 120D may not necessarily be arranged along the inclination but may be arranged to align along a flat line.

For another example, the embodiment described above may not necessarily be applied to a color printer but may be employed in, for example, a monochrome printer, a copier, or a multifunction peripheral device.

What is claimed is:

1. An image forming apparatus, comprising:

a frame;

a cartridge configured to be detachably attached to the frame along an attaching direction and comprising a first on-cartridge electrode and a second on-cartridge electrode;

a first electrode configured to protrude from the frame toward the cartridge and to contact the first on-cartridge electrode when the cartridge is in an attached state with respect to the frame;

a second electrode configured to protrude from the frame toward the cartridge and to contact the second on-cartridge electrode when the cartridge is in the attached state with respect to the frame, and a conveyer guide configured to guide a recording sheet, wherein the second electrode is arranged in a position on an upstream side of the first electrode with regard to the attaching direction of the cartridge and in a position to be passed through by the first on-cartridge electrode when the cartridge is moved to be attached to or detached from the frame;

wherein, when the cartridge is in a detached state with respect to the frame, a tip of the second electrode is in a position closer to the frame than a tip of the first electrode with regard to a facing direction, along which the cartridge and the frame face each other;

wherein the frame comprises a guide configured to guide the cartridge to move along the attaching direction;

wherein the guide comprises a first guiding part extending in a first direction and a second guiding part arranged on a downstream side of the first guiding part with regard to the attaching direction, the second guiding part extending in a second direction which is different from the first direction; and wherein the second guiding part extends from a transitive part, which is between the first guiding part and the second guiding part, toward a downstream along the second direction, the second guiding part extending to approach closer to the conveyer guide toward the downstream of the second direction.

2. The image forming apparatus according to claim 1, wherein each of the first electrode and the second electrode comprises a wire electrode comprising a ring portion, which is rounded at least twice in loops.

3. The image forming apparatus according to claim 2, wherein the ring portion of the second electrode is in an arrangement such that, when viewed along the facing direction, a diameter thereof inclines to be in parallel with the second direction.

4. The image forming apparatus according to claim 2, wherein the guide further comprises a third guiding part extending from a lower end of the second guiding part in a third direction which is different from the second direction; and wherein the ring portion of the first electrode is in an arrangement such that, when viewed along the facing direction, a diameter thereof inclines with respect to a horizontal direction at an angle, which is between an angle of the second guiding part with respect to the horizontal direction and an angle of the third guiding part with respect to the horizontal direction.

5. The image forming apparatus according to claim 1, wherein the first electrode is arranged on a downstream side of the transitive part with regard to the attaching direction; and wherein the second electrode is arranged on an upstream side of the transitive part with regard to the attaching direction.

6. The image forming apparatus according to claim 1, wherein the first electrode comprises a plurality of first electrodes, and the second electrode comprises a plurality of second electrodes;

wherein tips of the plurality of first electrodes are arranged in a same position with regard to the facing direction; and wherein tips of the plurality of second electrodes are arranged in a same position with regard to the facing direction.

7. The image forming apparatus according to claim 1, wherein the frame comprises a restrictive portion configured to restrict the first electrode and the second electrode from protruding from the frame.

8. The image forming apparatus according to claim 1, wherein the cartridge comprises a first guide and a second guide;

wherein the first guide is arranged on a downstream side of the first on-cartridge electrode with regard to the attaching direction and configured to compress the first electrode; and wherein the second guide is arranged on a downstream side of the second on-cartridge electrode with regard to the attaching direction and configured to be greater in a dimension along the attaching direction than the first guide, the second guide being configured to compress the second electrode.

* * * * *